US007827797B2

(12) United States Patent
Han et al.

(10) Patent No.: US 7,827,797 B2
(45) Date of Patent: Nov. 9, 2010

(54) INJECTION ASSEMBLY FOR A COMBUSTOR

(75) Inventors: Fei Han, Clifton Park, NY (US); Venkatraman Ananthakrishman Iyer, Mason, OH (US); Keith Robert McManus, Clifton Park, NY (US); Edip Sevincer, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 966 days.

(21) Appl. No.: 11/469,952

(22) Filed: Sep. 5, 2006

(65) Prior Publication Data

US 2008/0053097 A1 Mar. 6, 2008

(51) Int. Cl.
*F02C 1/00* (2006.01)

(52) U.S. Cl. ..... 60/746; 60/737; 431/114

(58) Field of Classification Search ..... 60/737, 60/738, 746, 752, 747, 804, 776, 725; 431/114, 431/8, 159, 174, 278, 285
See application file for complete search history.

(56) References Cited

U.S. PATENT DOCUMENTS

| | | | | | |
|---|---|---|---|---|---|
| 3,788,065 | A * | 1/1974 | Markowski | 60/773 |
| 4,351,156 | A | 9/1982 | White et al. | |
| 5,274,991 | A * | 1/1994 | Fitts | 60/800 |
| 5,357,745 | A * | 10/1994 | Probert | 60/39.37 |
| 5,636,510 | A * | 6/1997 | Beer et al. | 60/39.23 |
| 5,729,968 | A * | 3/1998 | Cohen et al. | 60/39.6 |
| 5,860,803 | A * | 1/1999 | Schindler et al. | 431/9 |
| 6,056,538 | A * | 5/2000 | Buchner et al. | 431/115 |
| 6,164,055 | A * | 12/2000 | Lovett et al. | 60/776 |
| 6,174,160 | B1 | 1/2001 | Lee et al. | |
| 6,272,840 | B1 | 8/2001 | Crocker et al. | |
| 6,311,473 | B1 | 11/2001 | Benjamin et al. | |
| 6,438,959 | B1 * | 8/2002 | Dean et al. | 60/760 |
| 6,481,212 | B2 | 11/2002 | Priestley | |
| 6,513,329 | B1 | 2/2003 | Snyder et al. | |
| 6,547,256 | B2 * | 4/2003 | Aksit et al. | 277/628 |
| 6,568,190 | B1 * | 5/2003 | Tiemann | 60/804 |
| 6,910,336 | B2 * | 6/2005 | Sullivan et al. | 60/798 |
| 6,923,002 | B2 * | 8/2005 | Crawley et al. | 60/772 |
| 6,968,693 | B2 | 11/2005 | Colibaba-Evulet et al. | |
| 6,983,605 | B1 | 1/2006 | Hook et al. | |
| 6,996,991 | B2 | 2/2006 | Gadde et al. | |
| 7,089,745 | B2 | 8/2006 | Roby et al. | |
| 7,578,130 | B1 * | 8/2009 | Kraemer et al. | 60/737 |
| 2003/0167771 | A1 * | 9/2003 | Hayashi et al. | 60/737 |
| 2008/0268387 | A1 * | 10/2008 | Saito et al. | 431/8 |
| 2009/0188255 | A1 * | 7/2009 | Green et al. | 60/737 |

FOREIGN PATENT DOCUMENTS

| | | | | |
|---|---|---|---|---|
| JP | 01088011 | * | 3/1989 | 431/8 |
| JP | 01088011 A | * | 4/1989 | |

* cited by examiner

*Primary Examiner*—Michael Cuff
*Assistant Examiner*—Young Choi
(74) *Attorney, Agent, or Firm*—Armstrong Teasdale LLP

(57) ABSTRACT

An injection assembly for use with a combustor is provided. The injection assembly includes an effusion plate that has a plurality of plate openings and a plate sleeve having a side-wall portion that includes a forward edge. The forward edge is coupled to the effusion plate such that the effusion plate is oriented obliquely with respect to a centerline extending through the combustor. The injection assembly also includes a plurality of ring extensions where each of the ring extensions is coupled to one of the plurality of plate openings. Each ring extension extends rearwardly into the plate sleeve.

20 Claims, 6 Drawing Sheets

INJECTION ASSEMBLY FOR A COMBUSTOR

BACKGROUND OF THE INVENTION

This invention relates generally to gas turbine engines, and, more specifically, to lean premixed combustors used with gas turbines.

Many known combustion turbine engines ignite a fuel-air mixture in a combustor and generate a combustion gas stream that is channeled to a turbine via a hot gas path. The turbine converts the thermal energy of the combustion gas stream to mechanical energy that rotates a turbine shaft. The output of the turbine may be used to power a machine, such as an electric generator or a pump.

Environmental concerns regarding exhaust emissions generated from combustive processes have resulted in regulations and other limits on gas turbine engines. In response, at least some industrial gas turbine engines include a combustor designed for low exhaust emissions operation, for example, a lean-premixed combustor. Known lean-premixed combustors typically include a plurality of burner cans, or combustors, that circumferentially adjoin each other around the circumference of the engine, such that each burner can includes a plurality of premixers joined together at its upstream end.

However, lean premixed combustors may be more susceptible to combustion instability due to pressure oscillations in the combustion chamber. Such instabilities can cause undesirable acoustic noise, deteriorate engine performance and reliability, and/or increase the frequency of required service. For example, combustion instability can cause flashback, flame blowout, starting problems, damage to combustor hardware, switchover problems, High Cycle Fatigue (HCF) of hot gas path components, and Foreign Object Damage (FOD) to turbine components. If there is extensive structural damage, system failure can occur.

One known method for reducing combustion instabilities involves distributing the axial position of the flame in the combustion chamber by physically offsetting one or more fuel injectors within the combustion chamber. However, in such a combustor, the extended surface associated with the downstream injectors must be actively cooled in order to be protected from the upstream flame. This additional cooling air has corresponding NOx emissions for the system. Another known method involves changing the distance between the centerbody and the cap for different premixers. By altering such distances, the spatial distribution of heat release rates for each premixer can mitigate the feedback gain. However, this method can be time-consuming because each premixer, or nozzle assembly, has a different configuration and different orientations and may not work for all operating conditions.

BRIEF DESCRIPTION OF THE INVENTION

In one aspect, an injection assembly for use with a combustor is provided. The injection assembly includes an effusion plate that has a plurality of plate openings and a plate sleeve having a sidewall portion that includes a forward edge. The forward edge is coupled to the effusion plate such that the effusion plate is oriented obliquely with respect to a centerline extending through the combustor. The injection assembly also includes a plurality of ring extensions where each of the ring extensions is coupled to one of the plurality of plate openings. Each ring extension extends rearwardly into the plate sleeve.

In another aspect, a combustor is provided. The combustor includes a plurality of premixers. The combustor further includes a cap assembly that has an injection assembly which includes an effusion plate having a plurality of plate openings. The injection assembly also includes a plate sleeve that has a sidewall portion with a forward edge. The forward edge is coupled to the effusion plate such that the effusion plate is oriented obliquely with respect to a centerline extending through the combustor. The injection assembly also includes a plurality of ring extensions where each of the ring extensions is coupled to one of the plurality of plate openings. Each ring extension extends rearwardly into the plate sleeve and couples in flow communication to one of the plurality of premixers.

In another aspect, a method for assembling a combustor to facilitate reducing combustion dynamics in the combustor is provided. The method comprises providing at least one cap assembly having an injection assembly that includes an effusion plate with a plurality of plate openings. The injection assembly also includes a plate sleeve having a sidewall portion with a forward edge. The forward edge is coupled to the effusion plate such that the effusion plate is oriented obliquely with respect to a centerline extending through the combustor. A plurality of ring extensions are each coupled to one of the plurality of plate openings such that the ring extensions each extend into the plate sleeve. The method also includes coupling each ring extension to a premixer

DETAILED DESCRIPTION OF THE INVENTION

Premixed combustors generally includes a plurality of premixers that direct a fuel-air mixture into a combustion chamber. Because known premixers typically are cylindrical, it is possible for oscillations generated from the heat release rate of the flame to couple with acoustic waves originating from the fuel-air premixer. Such a phenomenon is called thermoacoustic coupling which may cause deleterious effects on the combustor and turbine engine if it becomes too severe.

Figure 1:
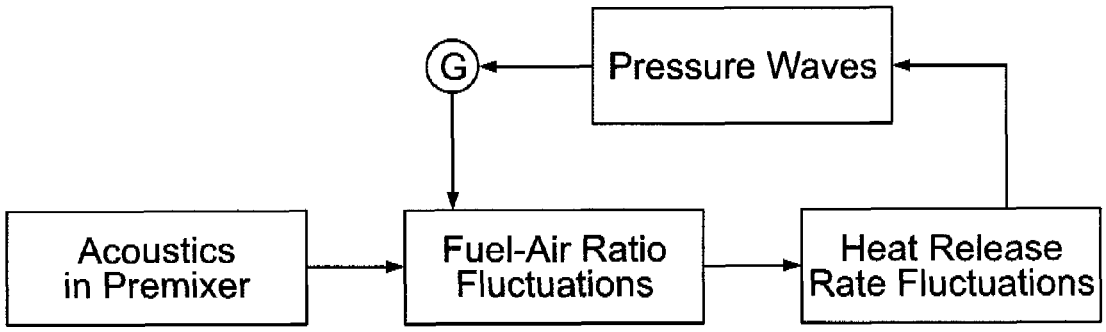
FIG. 1 illustrates an exemplary feedback loop that occurs during thermoacoustic coupling.

The process of thermoacoustic coupling is illustrated by the feedback loop depicted in FIG. 1. Inherent acoustic phenomenon occurring in a premixer cause fluctuations in the fuel-air ratio which, in turn, cause fluctuations in the heat release rate at the flame front. The heat release rate fluctuations are delayed with a time, $\tau$, relative to the fuel-air ratio fluctuations. The time delay, $\tau$, is given by L/U where L is the distance between the general point of fuel injection and the flame front. U is the mean flow velocity of the fuel-air mixture. The fluctuations in the heat release rate cause pressure waves to propagate upstream from the flame front which then modulate the fuel-air fluctuations with a feedback gain, G, known as the Rayleigh gain factor. Equation (1) shows that the Rayleigh gain can be estimated by the product of the unsteady heat release and pressure oscillation and that the gain depends on the frequency of oscillations, ω and the time delay, τ.

$$G = pQ \approx \cos\left(\omega \frac{L}{U}\right) \quad \text{Equation (1)}$$

A positive Rayleigh gain implies that the unsteady heat release amplifies the pressure oscillations and the oscillations grow in time until they reach an equilibrium level where viscous damping matches the growth rate of oscillations. On the other hand, a negative value for G dampens the pressure oscillations.

As shown in Equation (1), the feedback loop gain for each premixer 34 is a function of L, U, ω. Typical combustion systems in gas turbines, however, have multiple premixers. The overall feedback loop gain is described in Equation (2).

$$G = \sum_{j=1}^{N} \cos\left(\omega \frac{L_j}{U}\right) \quad \text{Equation (2)}$$

As shown above, overall feedback gain can be changed substantially by changing the distance between the general point of fuel injection and the flame front, L. Because the frequency of oscillations can change, however, a standard L for all premixers could result in a negative gain while at one frequency, or at other times, a positive gain while at a different frequency. Thus, to facilitate avoiding the development of a positive gain, some embodiments of the present invention include arrangements and configurations of premixers and cap subassemblies that alter the distance L in the combustor.

Figure 2:
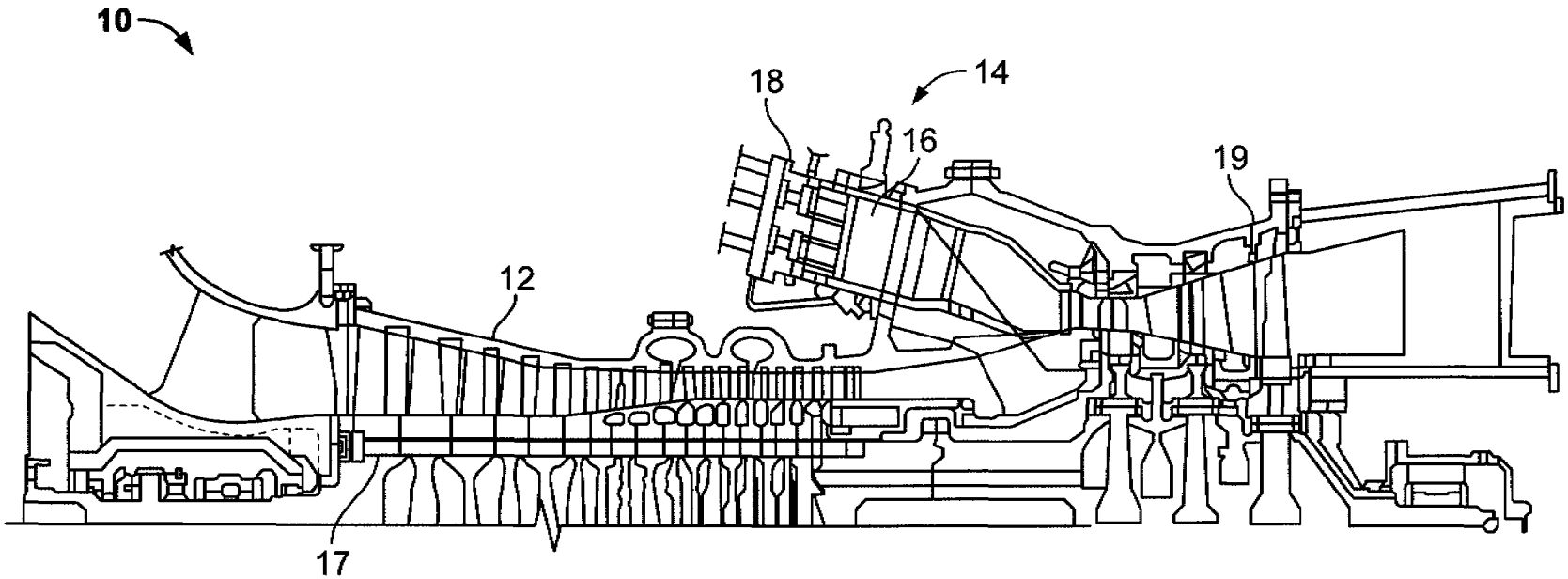
FIG. 2 is a schematic illustration of an exemplary combustion turbine engine.

FIG. 2 is a schematic illustration of an exemplary combustion turbine engine 10. Engine 10 includes a compressor 12 and a combustor assembly 14. Combustor assembly 14 includes a combustion chamber 16 and a fuel nozzle assembly 18. Engine 10 also includes a turbine 17 and a common compressor/turbine shaft 19 (sometimes referred to as rotor 19). The present invention is not limited to any one particular engine and may be implanted in connection with several engines including, for example, the MS7001FA (7FA), MS9001FA (9FA), and MS9001FB (9FB) engine models of General Electric Company.

Combustor assembly 14 can include one combustor 24 or a plurality of combustors 24. In operation, air flows through compressor 12 in order to supply compressed air to the combustor(s) 24. Specifically, a substantial amount of the compressed air is supplied to fuel nozzle assembly 18 that is integral to combustor assembly 14. Some combustors 24 channel at least a portion of air flow from compressor 12 distributed to a dilution air sub-system (not shown in FIG. 2) and most combustors 24 have at least some seal leakage. Fuel nozzle assembly 18 is in flow communication with combustion chamber 16. Assembly 18 is also in flow communication with a fuel source (not shown in FIG. 2) that channels fuel and air to combustors. In an exemplary embodiment, combustor assembly 14 includes a plurality of combustors 24 and fuel nozzle assemblies 18.

Each combustor 24 within combustor assembly 14 ignites and combusts fuel, such as, natural gas and/or oil, that generates a high temperature combustion gas stream. Combustor assembly 14 is in flow communication with turbine 17 where gas stream thermal energy is converted to mechanical rotational energy. Turbine 17 is rotatably coupled to and drives rotor 19. Compressor 12 also is rotatably coupled to shaft 19.

Figure 3:
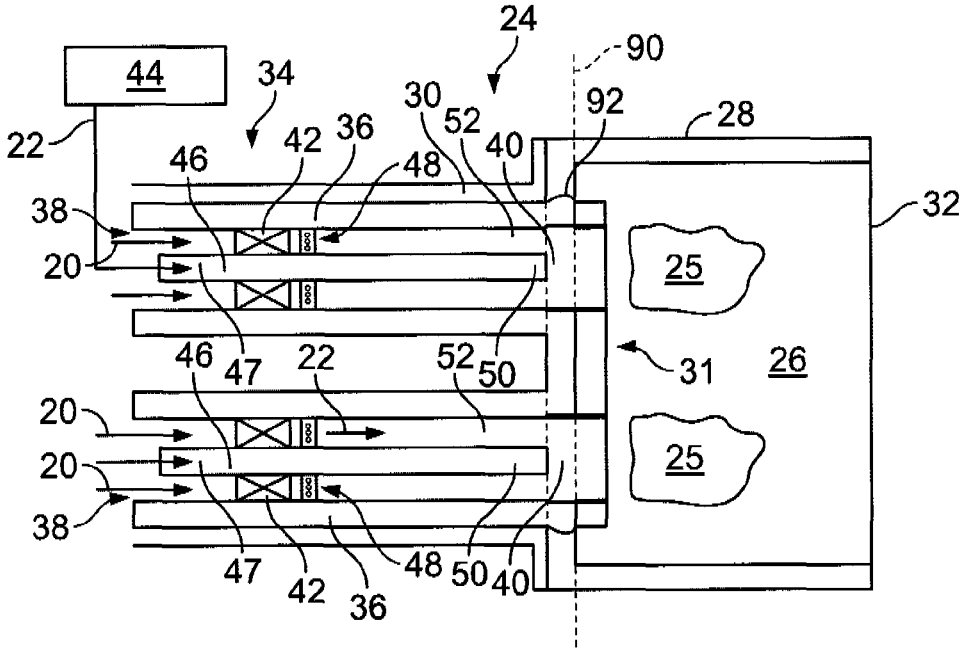
FIG. 3 is a fragmentary illustration of a portion of a combustor assembly that may be used with the turbine engine shown in FIG. 2.

FIG. 3 illustrates an exemplary combustor 24 that may be used with turbine engine 10. Combustor 24 is one of a plurality of combustors 24 that can be used in combustor assembly 14, however, for illustrative purposes, only one combustor 24 is described in detail herein. Combustor 24 includes a combustion chamber 26 that is defined by a tubular combustion casing 28 (also referred to as a liner) where combustion of fuel occurs. Casing 28 couples to a cap assembly 30 at an upstream end chamber 26. Cap assembly 30 includes a injection assembly 31. Chamber 26 also includes an outlet 32 defined at a downstream end of chamber 26. Outlets 32 from a plurality of combustion chambers 26 are coupled together in flow communication in common discharge directed towards turbine 17.

Combustor 24 also includes a plurality of premixers 34 that are surrounded by and coupled to cap assembly 30. Although only two adjacent premixers 34 are illustrated, the present invention is not limited to such a configuration. For example, FIGS. 5A-5C (described below) illustrate a cap assembly that may be used with a combustor including six premixers. Those skilled in the art and guided by the teachings described herein know that many configurations for premixers 34 exist that can be used in a combustor.

Each premixer 34 includes a tubular duct 36 having an inlet 38 at an upstream end of premixer 34. Inlet 38 receives compressed air 20 from compressor 12 (shown in FIG. 2). Furthermore, duct 36 includes an outlet 40 at a downstream end. Outlet 40 is coupled in flow communication with combustion chamber 26 through a corresponding opening formed in injection assembly 31. Injection assembly 31 has a larger diameter than the collective diametric extent of the plurality of premixers 34 which enables premixers 34 to each discharge into the larger volume defined by combustion chamber 26. As is known in the art, flat injection assembly 31 is substantially planar.

In the exemplary embodiment, premixer 34 also includes an elongated centerbody 46 that is positioned concentrically within a duct 36. Each centerbody 46 includes an upstream end 47 adjacent duct inlet 38, and a bluff or flat downstream end 50 adjacent duct outlet 40. Each centerbody 46 is spaced radially inwardly from duct 36 such that a substantially cylindrical load channel 52 is defined therebetween.

In addition, in the exemplary embodiment, premixer 34 also includes a swirler 42 for swirling compressed air 20. Swirler 42 is positioned within duct 36 and, in some embodiments, centerbody 46 is coupled to, and extends through the approximate center of swirler 42. Swirler 42 includes a plurality of circumferentially spaced vanes exposed in a channel 52 of duct 36. Although swirlers 42 are closer to inlet 38 in FIG. 3, alternative embodiments of the present invention have swirlers that are substantially between inlet 38 and outlet 40 or have swirlers that are closer to outlet 40.

A fuel injector 44 injects fuel 22, such as a natural gas, into each channel 52 of each duct 36 for mixing with swirled air 20. While combustor 24 is in use, the mixture of fuel-air flows through channel 52 toward outlet 40 and into combustion chamber 26 to generate combustion flame 25. In some embodiments, fuel injector 44 is in flow communication with each channel 52 via centerbody 46. Fuel injector 44 can include conventional components such as a fuel reservoir, conduits, valves and any required pumps for channeling fuel 22 into the centerbodies 46. In FIG. 3, a fuel injection outlet 48 is positioned between swirlers 42 and outlet 40. Fuel injection outlet 48 is coupled to fuel injector 44 for injecting fuel 22 into channel 52. Fuel injection outlet 48 can have one or more orifices 49 that are spaced from each other in order to facilitate mixing the fuel with the air. In one embodiment, orifices 49 are axially spaced from each other.

Figure 7A:
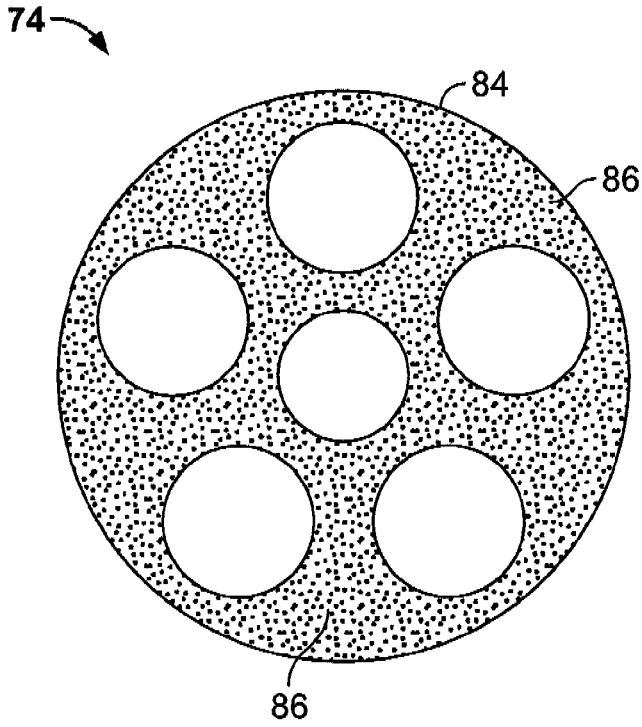
FIGS. 7A and 7B illustrate exemplary effusion plates that may be used with the injection assembly shown in FIG. 6.
Figure 7B:
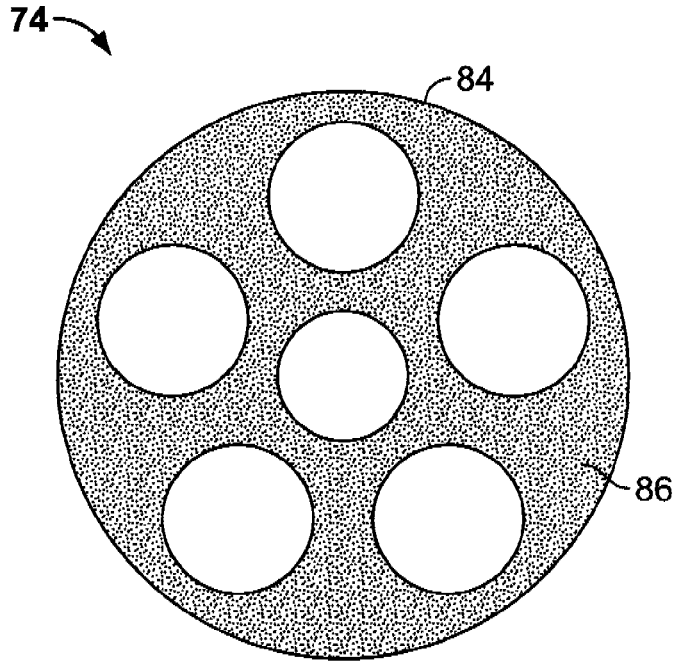

Premixers 34 used within an embodiment of the present invention can have various sizes and configurations. For example, FIGS. 7A and 7B illustrates an effusion plate (discussed below) used with one embodiment, wherein the middle premixer has a smaller diameter than the other premixers. Also, swirlers 42 or fuel injection orifices 49 may be placed at differing axial distances within duct 36 for each premixer 34 in combustor 24.

Figure 5A:
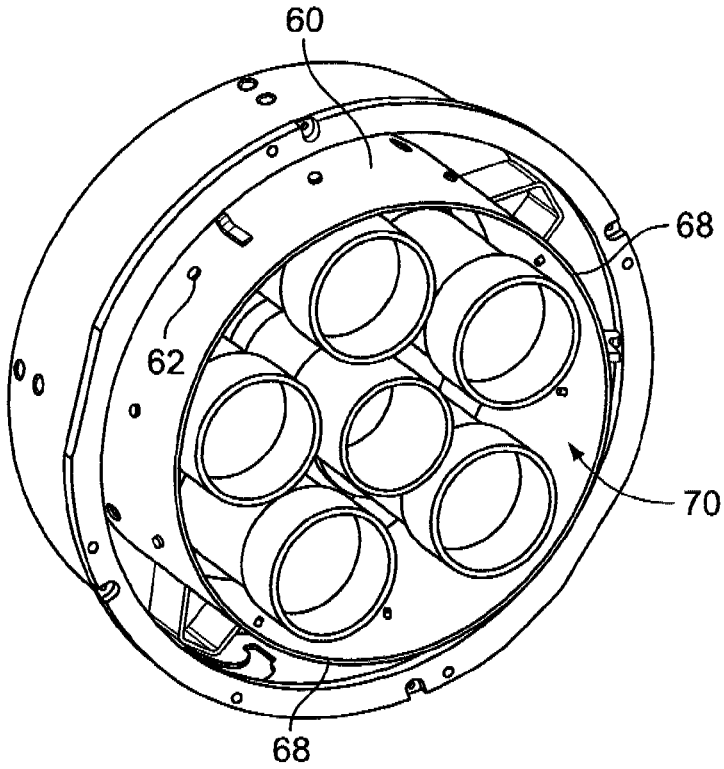
FIGS. 5A-5C are perspective views of a cap assembly that may be used with the combustion turbine engine shown in FIG. 2 and in various stages of assembly.

As discussed above, a cap assembly 30 is coupled to casing 28. Cap assembly 30 surrounds and supports premixers 34. FIG. 5A illustrates a cap assembly 30 which includes a substantially cylindrical first sleeve 60. In some embodiments, sleeve 60 is provided with circumferentially spaced cooling holes 62 which permit compressor air to flow into chamber 26. Cap assembly 30 can include a rear plate (not shown) which is generally circular in shape and is welded to sleeve 60 along its peripheral edge. Rear plate includes a plurality of openings, each opening corresponding to one premixer 34. When cap assembly 30 is fully assembled, rear plate provides support for premixers 34.

The forward or downstream end of first cylindrical sleeve 60 terminates at an annular edge 68. An opening 70 defined by annular edge 68 of sleeve 60 is configured to receive an injection subassembly 72. As shown in FIGS. 5A-5C and 6, injection assembly 72 includes an effusion plate 74 forming a plurality of openings 76, a rearwardly extending plate sleeve 78, and a plurality of ring extensions 80. Generally, injection assemblies (such as injection assembly 31 shown in FIG. 3) form a substantially perpendicular plane in relation to the direction of fuel-air mixture flow. FIGS. 4, 5A-5C, and 6 illustrate injection assembly 72, which is not perpendicular to air flow. Injection assembly 72 forms a slanted dump plane 190, which is slightly oblique to airflow.

Figure 6:
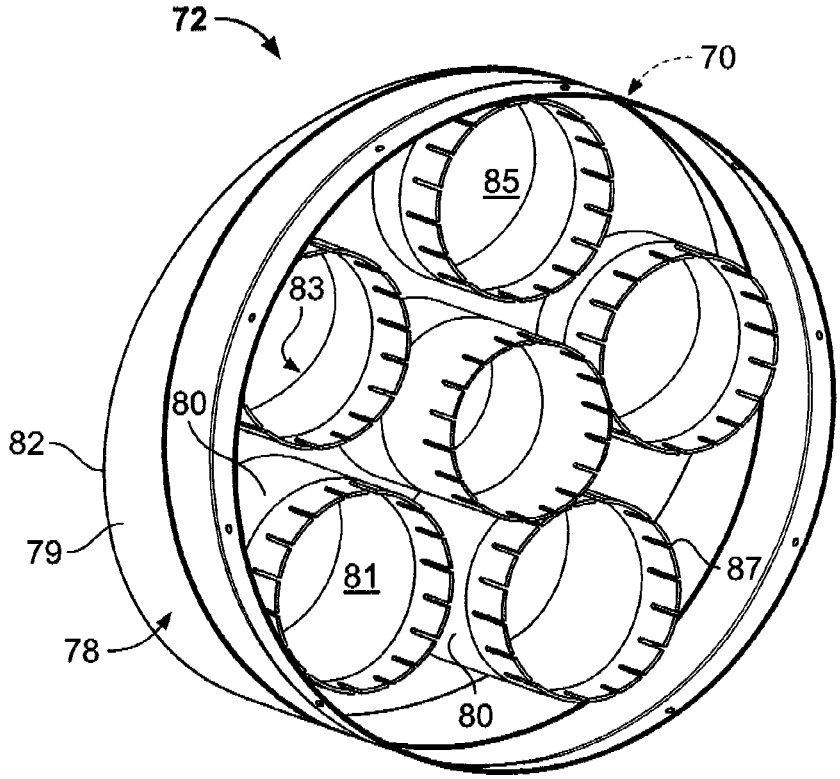
FIG. 6 illustrates an exemplary injection assembly that may be used with the cap assembly shown in FIGS. 5A-5C.

As shown in FIG. 6, each ring extension 80 includes a sidewall portion 81 which surrounds and defines a ring channel. Ring extension 80 terminates at a forward end of sidewall 81 forming a slanted edge 83. Edge 83 defines a forward opening 85 of ring extension 80. Ring extension 80 also terminates at an aft end forming an aft edge 87. In some embodiments, aft edge 87 and a portion of adjacent sidewall 81 are slotted. Aft edge 87 defines a circumference of extension 80, which is typically large enough to receive an end of premixer 34. However, the circumference of extension 80 could also be configured to be received by premixer 34. When in use, each ring extension 80 is in substantial axial alignment with a corresponding premixer 34.

Slanted edge 83 of each ring extension 80 is configured to couple to a corresponding opening edge 77 of effusion plate 74. Each opening edge 77 defines an opening 76 of effusion plate 74. As shown in FIGS. 7A and 7B, in some embodiments, effusion plate 74 includes a plurality of cooling holes 86. Cooling holes 86 may be straight or inclined. In one embodiment, cooling holes 86 are straight. Cooling holes 86 can have a variety of patterns on effusion plate 74 as shown in FIGS. 7A and 7B.

Rearwardly extending plate sleeve 78 includes a sidewall portion 79 and an outer edge 82 that, in the exemplary embodiment, defines an elliptically-shaped opening (not shown). Edge 82 couples to an outer edge 84 of effusion plate 74. Because injection assembly 72 is inclined or obliquely oriented relative to premixers 34, in some embodiments, each of plate sleeve opening, effusion plate opening 76, opening edge 76, effusion plate 74, extension opening 85, and edge 83 have a slightly oval or elliptical shape. In one embodiment, injection assembly 72 is oriented at an angle of approximately 26° relative to each duct outlet 40 of premixers 34. Duct outlet 40 is about perpendicular to airflow.

Figure 5B:
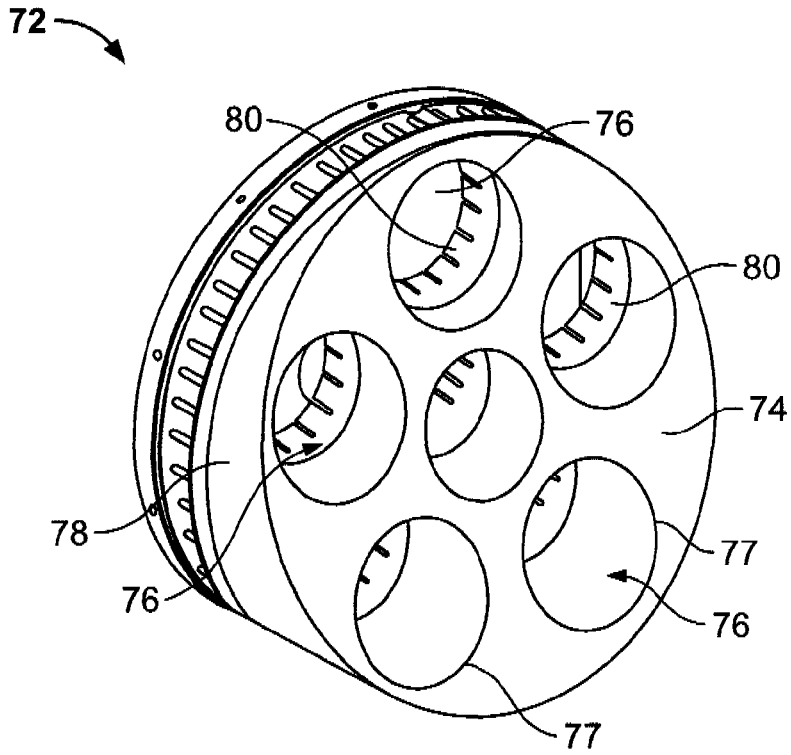
Figure 5C:
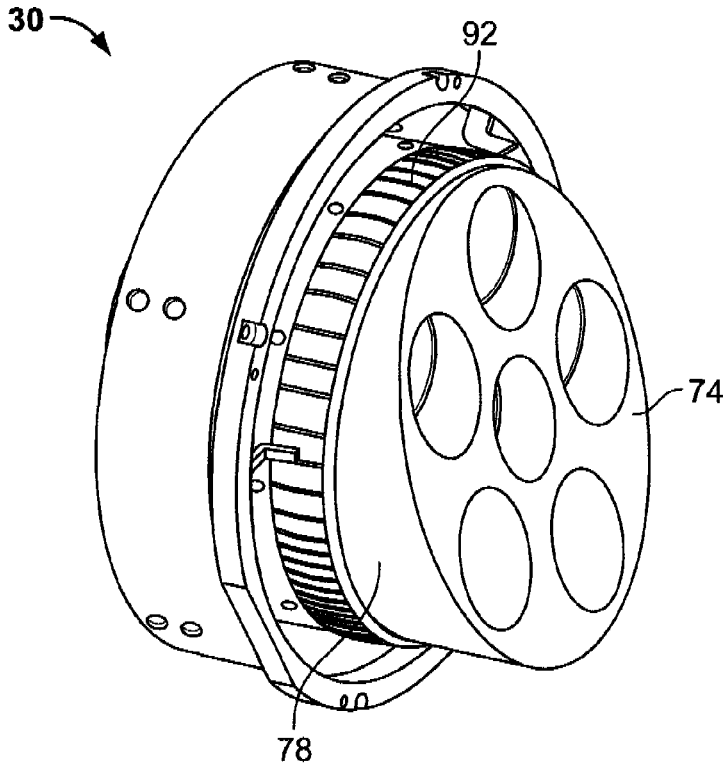

Plate sleeve 78 is sized to be received by first cylindrical sleeve 60 at an aft end of sleeve 78, and is coupled to sleeve 60 after being received (as shown in FIGS. 5A-5C) by sleeve 60. In one embodiment, plate sleeve 78 is riveted to cylindrical sleeve 60.

An annular leaf spring 92 (shown in FIGS. 3, 4, and 5C) is secured about a forward portion of sleeve 60, and is conformed to engage either cap assembly 30 and/or casing 28. In one embodiment, spring 92 is configured to engage an inner surface of combustion casing 28 when cap assembly 30 is inserted within a rearward end of casing 28.

Figure 4:
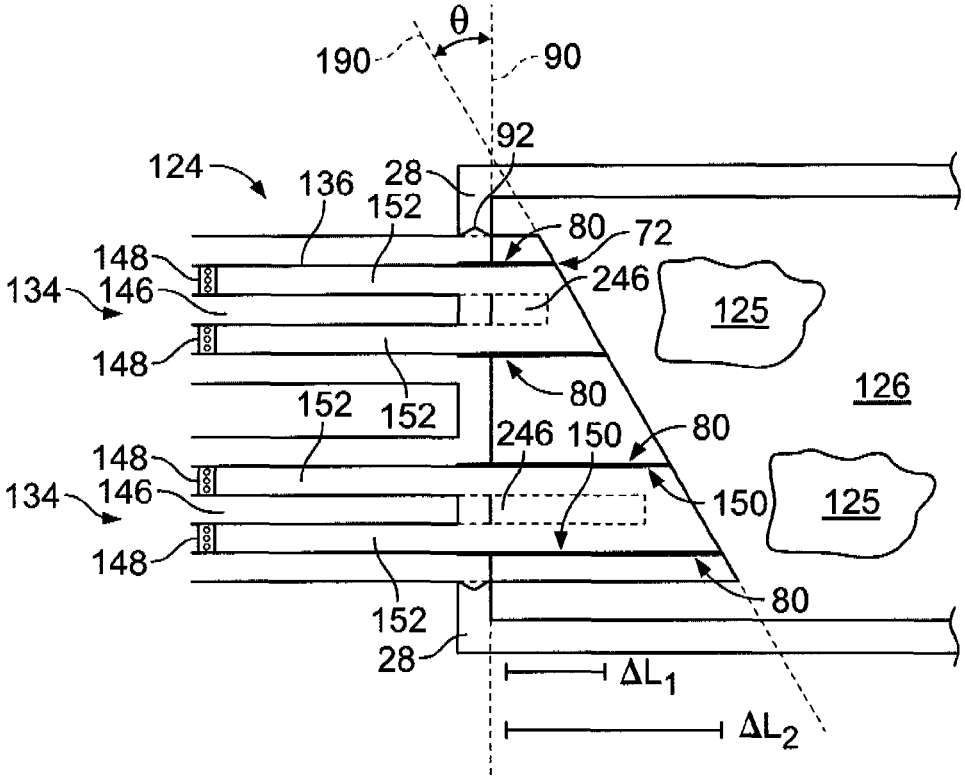
FIG. 4 is an enlarged cross-sectional view of an exemplary cap assembly that may be used with the combustion turbine engine shown in FIG. 2.

FIG. 4 illustrates an exemplary embodiment of the present invention. Specifically, FIG. 4 shows an enlarged portion of a combustor 124, which is substantially similar to combustor 24 as described above. As shown in FIG. 4, the fuel-air mixture enters chamber 126 through injection assembly 72 and slanted dump plane 190. Injection assembly 72 effectively changes distance L for each premixer 134, which causes the pressure oscillations to be out-of-phase such that the oscillations destructively interfere with one another, thus reducing combustion dynamics. Each ring extension 80 receives a premixer 134. In some embodiments, a forward portion of each premixer 134 is not fixed to injection assembly 72, thereby facilitating removal of each premixer 134 for repair and/or replacement without also removing other parts of cap assembly 130.

Combustor 124 includes a plurality of premixers 134 that each include centerbodies 146, channels 152, and swirlers (not shown). A fuel injection outlet 148 injects fuel into a corresponding premixer 134 coupled to injection assembly 72. Each injection assembly 72 lengthens the distance that the fuel-air mixture in each premixer 134 must travel (shown as $\Delta L_1$ and $\Delta L_2$). The distance is measured from outlet 148 downstream to slanted dump plane 190 which is approximately where the flame front of flame 125 is generated.

Effusion plate 74 and centerbody 146 operate to provide a bluff body that acts as a flameholder for combustion flame 125. While using injection assembly 72, the increased axial distance of channel 52 may affect this ability to act as a flameholder. For example, combustion may occur within ring extension 80. Thus, in some embodiments, a centerbody extension 246 is added to one or more centerbodies 146. Furthermore, in some embodiments, a premixer duct extension 150 is added to duct 136 to facilitate the flow of the fuel-air mixture and to facilitate preventing cap leakage.

Injection assembly 72 provides a method for tuning (i.e., reducing feedback gain) combustors under different operating conditions so as not to cause excessive pressure oscillations. The tuning can be achieved by slanting the cap at different angles thereby changing the relative acoustic feedback lengths for the different premixers. An angle θ is defined as the angle formed by axis 90 and dump plane 190. Axis 90 (shown in FIGS. 3 and 4) is substantially perpendicular to the direction of fuel-air mixture flow. In some embodiments, angle θ is less than or equal to 26°. In one embodiment, angle θ is equal to 26°.

In some embodiments, to facilitate the tuning of the combustor 124 or to facilitate reducing extended spark plug interference, effusion plate 74 (and injection assembly 72) is rotated clockwise or counterclockwise as viewed upstream. In one embodiment, this rotation is approximately 28.5° counterclockwise.

The present invention also provides a method for manufacturing a combustor, similar to combustor 124 described above, which is configured to reduce combustion dynamics. The method includes coupling a plurality of premixers to a injection assembly. The injection assembly includes an effusion plate, plate sleeve, and a plurality of ring extensions, wherein each premixer is coupled to a corresponding ring extension. The premixers are configured in substantially the same manner as premixers 34 and 134, described above.

The present invention also provides for a method of manufacturing a injection assembly, similar to injection assembly 72 described above. The method includes coupling an edge of a injection sleeve to an effusion plate having openings. The method further includes coupling each opening of the effusion plate to a ring extension. The injection assembly is configured to be received by a cap assembly.

The present invention also provides a method for reducing combustion dynamics in a combustor. The combustor includes a combustion chamber having a cap assembly at an upstream end and an outlet at a downstream end, and also includes a plurality of premixers. The method includes injecting fuel through a fuel injector that has a plurality of fuel injection orifices within each premixer of the plurality of premixers. The method also includes mixing air with the fuel in each premixer to form a fuel-air mixture, which is then discharged into the combustion chamber combusting the mixtures of each premixer. The combustion results in a corresponding flame. The flame occurs at a distance (L) from the fuel injection orifices of the corresponding premixer. The corresponding flame causes the mixture to oscillate as fuel concentration waves so that the corresponding fuel concentration waves are out of phase with each other, i.e., destructively interfere with each other.

The above-described combustors, assemblies, and methods for reducing combustion dynamics facilitate extending the useful life of some combustor components and allows combustor components to be constructed in a more cost-effective and reliable manner. More specifically, the combustors and methods described herein facilitate enhancing the life of a turbine engine component.

Exemplary embodiments of a method, combustor, and injection assembly for reducing combustion dynamics are described above in detail. The method, combustor, and injection assembly are not limited to the specific embodiments described herein, but rather, steps of the method and/or components of the combustor and assembly may be utilized independently and separately from other steps and/or components described herein. Further, the described method steps and/or combustor components can also be defined in, or used in combination with, other methods and/or combustors, and are not limited to practice with only the method and combustor as described herein.

While the invention has been described in terms of various specific embodiments, those skilled in the art will recognize that the invention can be practiced with modification within the spirit and scope of the claims.

What is claimed is:

1. An injection assembly for use with a combustor, said assembly comprising:

an effusion plate comprising a plurality of plate openings;

a plate sleeve comprising a sidewall portion comprising a forward edge, said forward edge coupled to said effusion plate such that said effusion plate is oriented obliquely with respect to a centerline extending through the combustor; and a plurality of ring extensions, each of said ring extensions is coupled to one of said plurality of plate openings, each said ring extension extends rearwardly into said plate sleeve, each of said ring extensions comprises a sidewall coupled to said effusion plate, said sidewall comprising a first end aligned obliquely with respect to the centerline, said plurality of ring extensions comprise at least one first ring extension having a first length and at least one second ring extension having a second length that is different than the first length.

2. An assembly in accordance with claim 1 wherein said forward edge defines a sleeve opening of said plate sleeve, said sleeve opening is substantially elliptically-shaped.

3. An assembly in accordance with claim 1 wherein at least one of said plurality of ring extensions is configured to receive a combustor premixer therein.

4. An assembly in accordance with claim 1 wherein said effusion plate further comprises a plurality of cooling holes.

5. An assembly in accordance with claim 1 wherein each at least one of said plurality of ring extensions is slotted.

6. An assembly in accordance with claim 2 wherein said effusion plate is substantially elliptically-shaped.

7. An assembly in accordance with claim 1 wherein said injection assembly is rotatable relative to the centerline extending through the combustor.

8. A combustor comprising:

a plurality of premixers; and a cap assembly comprising an injection assembly, said injection assembly comprising:

an effusion plate comprising a plurality of plate openings;

a plate sleeve comprising a sidewall portion comprising a forward edge, said forward edge coupled to said effusion plate such that said effusion plate is oriented obliquely with respect to a centerline extending through the combustor; and a plurality of ring extensions, each of said ring extensions is coupled to one of said plurality of plate openings, each said ring extension extends rearwardly into said plate sleeve, each of said ring extensions comprises a sidewall coupled to said effusion plate, said sidewall comprising a first end that is aligned obliquely with respect to the centerline, and wherein each of said ring extensions is coupled in flow communication to one of said plurality of premixers, said plurality of ring extensions comprise at least one first ring extension having a first length and at least one second ring extension having a second length that is different than the first length.

9. A combustor in accordance with claim 8 wherein said forward edge defines a sleeve opening of said plate sleeve, said sleeve opening is substantially elliptically-shaped.

10. A combustor in accordance with claim 8 wherein said cap assembly facilitates reducing combustion dynamics of said combustor.

11. A combustor in accordance with claim 8 wherein each of said plurality of premixers comprises at least one swirler and a centerbody.

12. A combustor in accordance with claim 8 wherein at least one of said plurality of premixers comprises a fuel injection outlet comprising a plurality of fuel injection orifices configured to discharge fuel into the premixer.

13. A combustor in accordance with claim 8 wherein said effusion plate further comprises a plurality of cooling holes.

14. A combustor in accordance with claim 12 wherein a Rayleigh Gain (G) defined for said plurality of premixers is defined as:

$$G = \sum_{j=1}^{N} \cos\left(\omega \frac{L_j}{U}\right);$$

wherein for each said premixer U is the mean flow velocity of the fuel-air mixture, ω is the frequency of oscillations, and $L_j$ is the distance L from said fuel injection outlet to said effusion plate, wherein G is zero or negative.

15. A combustor in accordance with claim 8 wherein each of said plurality of premixers is removably coupled to one of said plurality of ring extensions.

16. A method for assembling a combustor to facilitate reducing combustion dynamics in the combustor, said method comprising:

providing at least one cap assembly that includes an injection assembly having an effusion plate including a plurality of plate openings, a plate sleeve including a sidewall portion having a forward edge, the forward edge coupled to the effusion plate such that the effusion plate is oriented obliquely with respect to a centerline extending through the combustor, and a plurality of ring extensions that are each coupled to one of the plurality of plate openings such that the ring extensions each extend into the plate sleeve, each of the ring extensions includes a sidewall coupled to the effusion plate, wherein the sidewall has a first end that is aligned obliquely with respect to the centerline, and wherein the plurality of ring extensions include at least one first ring extension having a first length and at least one second ring extension having a second length that is different than the first length; and coupling each ring extension to a premixer.

17. A method in accordance with claim 16 wherein coupling each ring extension to a premixer comprises coupling the ring extension to the premixer to facilitate reducing combustion dynamics in the combustor.

18. A method in accordance with claim 16 wherein providing at least one cap assembly comprises providing at least one cap assembly that includes the forward edge defining a sleeve opening of the plate sleeve, wherein the sleeve opening is substantially elliptically-shaped.

19. A method in accordance with claim 16 wherein coupling each ring extension to a premixer comprises coupling each ring extension to a premixer having at least one swirler and a centerbody.

20. A method in accordance with claim 16 wherein providing at least one cap assembly comprises providing at least one cap assembly that includes the effusion plate having a plurality of cooling holes.

* * * * *